US009809892B1

(12) United States Patent
Qin et al.

(10) Patent No.: US 9,809,892 B1
(45) Date of Patent: Nov. 7, 2017

(54) INDIUM ELECTROPLATING COMPOSITIONS CONTAINING 1,10-PHENANTHROLINE COMPOUNDS AND METHODS OF ELECTROPLATING INDIUM

(71) Applicant: Rohm and Haas Electronic Materials LLC, Marlborough, MA (US)

(72) Inventors: Yi Qin, Westborough, MA (US); Kristen Flajslik, Hopkinton, MA (US); Mark Lefebvre, Hudson, NH (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

(21) Appl. No.: 15/212,737

(22) Filed: Jul. 18, 2016

(51) Int. Cl.

| | |
|---|---|
| ***C25D 3/00*** | (2006.01) |
| ***C25D 3/54*** | (2006.01) |
| ***C25D 21/04*** | (2006.01) |
| ***C25D 5/02*** | (2006.01) |
| ***C25D 7/12*** | (2006.01) |

(52) U.S. Cl.
CPC ..... *C25D 3/54* (2013.01); *C25D 5/022* (2013.01); *C25D 7/123* (2013.01); *C25D 21/04* (2013.01)

(58) Field of Classification Search
CPC ..... C25D 3/02; C25D 3/54
USPC ..... 205/261
See application file for complete search history.

(56) References Cited

U.S. PATENT DOCUMENTS

| | | | | |
|---|---|---|---|---|
| 4,626,324 | A | 12/1986 | Samuels et al. | |
| 6,331,240 | B1 | 12/2001 | Tsunoda et al. | |
| 6,436,269 | B1 * | 8/2002 | Opaskar | C25D 3/60 205/244 |
| 7,023,089 | B1 * | 4/2006 | Lu | H01L 23/3735 257/705 |
| 7,151,049 | B2 | 12/2006 | Beica et al. | |
| 8,460,533 | B2 | 6/2013 | Szocs et al. | |
| 2006/0113006 | A1 * | 6/2006 | Masuda | C25D 3/60 205/302 |
| 2009/0188808 | A1 | 7/2009 | Wang et al. | |
| 2011/0103022 | A1 * | 5/2011 | Szocs | C25D 3/54 361/717 |
| 2013/0224515 | A1 * | 8/2013 | Foyet | C25D 7/005 428/673 |

OTHER PUBLICATIONS

Munoz et al., "Electrodeposition of Indium onto Vitreous Carbon from Acid Chloride Solutions," Journal of the Electrochemical Society (no month, 1999), vol. 146, No. 6, pp. 2123-2130.*

Saidman, et al., Anodic Behaviour of Indiumin Sodium Chloride Solutions, Electrochimica Acta, vol. 36, No. 14, (1991), pp. 2063-2067.

Fouda, et al., Electrodeposition of Indium, Bulletin de la Societe Chimique de France, No. 2, (1987), pp. 270-272.

Sykut, et al., Effect of Thiourea on Polarographic Reduction of Indium (III) i Perchloric Acid, Analytical Chemistry, vol. 54, No. 3, (1982), pp. 600-602.

* cited by examiner

*Primary Examiner* — Edna Wong
(74) *Attorney, Agent, or Firm* — John J. Piskorski

(57) ABSTRACT

Iridium electroplating compositions containing 1,10-phenanthroline compounds in trace amounts to electroplate substantially defect-free uniform and smooth surface morphology indium on metal layers. The indium electroplating compositions can be used to electroplate indium metal on metal layers of various substrates such as semiconductor wafers and as thermal interface materials.

6 Claims, 4 Drawing Sheets

INDIUM ELECTROPLATING COMPOSITIONS CONTAINING 1,10-PHENANTHROLINE COMPOUNDS AND METHODS OF ELECTROPLATING INDIUM

FIELD OF THE INVENTION

The present invention is directed to indium electroplating compositions containing 1,10-phenanthroline compounds in trace amounts and methods for electroplating indium metal on metal layers. More specifically, the present invention is directed to indium electroplating compositions containing 1,10-phenanthroline compounds in trace amounts and methods of electroplating indium metal on metal layers where the indium metal deposit is uniform, substantially void-free and has a smooth surface morphology.

BACKGROUND OF THE INVENTION

The ability to reproducibly plate void-free uniform indium of target thickness and smooth surface morphology on metal layers is challenging. Indium reduction occurs at potentials more negative than that of proton reduction, and significant hydrogen bubbling at the cathode causes increased surface roughness. Indium ($1^+$) ions, stabilized due to the inert pair effect, formed in the process of indium deposition catalyze proton reduction and participate in disproportionation reactions to regenerate Indium ($3^+$) ions. In the absence of a complexing agent, indium ions begin to precipitate from solutions above pH>3. Plating indium on metals such as nickel, tin, copper and gold is challenging because these metals are good catalysts for proton reduction and are more noble than indium, thus they can cause corrosion of indium in a galvanic interaction. Indium may also form undesired intermetallic compounds with these metals. Finally, indium chemistry and electrochemistry have not been well studied, thus interactions with compounds that may serve as additives are unknown.

In general, conventional indium electroplating baths have not been able to electroplate an indium deposit which is compatible with multiple under bump metals (UBM) such as nickel, copper, gold and tin. More importantly, conventional indium electroplating baths have not been able to electroplate indium with high coplanarity and high surface planarity on substrates which include nickel. Indium, however, is a highly desirable metal in numerous industries because of its unique physical properties. For example, it is sufficiently soft such that it readily deforms and fills in microstructures between two mating parts, has a low melting temperature (156° C.) and a high thermal conductivity (~82 W/m° K), good electrical conductivity, good ability to alloy and form intermetallic compounds with other metals in a stack. It may be used as low temperature solder bump material, a desired process for 3D stack assembly to reduce damage on assembled chips by the thermal stress induced during reflow processing. Such properties enable indium for various uses in the electronics and related industries including in semiconductors and polycrystalline thin film solar cells.

Iridium can also be used as thermal interface materials (TIMs). TIMs are critical to protect electronic devices such as integrated circuits (IC) and active semiconductor devices, for example, microprocessors, from exceeding their operational temperature limit. They enable bonding of the heat generating device (e.g. a silicon semiconductor) to a heat sink or a heat spreader (e.g. copper and aluminum components) without creating an excessive thermal barrier. The TIM may also be used in assembly of other components of the heat sink or the heat spreader stack that composes the overall thermal impedance path.

Several classes of materials are being used as TIMs, for example, thermal greases, thermal gels, adhesives, elastomers, thermal pads, and phase change materials. Although the foregoing TIMs have been adequate for many semiconductor devices, the increased performance of semiconductor devices has rendered such TIMs inadequate. Thermal conductivity of many current TIMs does not exceed 5 W/m° K and many are less than 1 W/m° K. However, TIMs that form thermal interfaces with effective thermal conductivities exceeding 15 W/m° K are presently needed.

Accordingly, indium is a highly desirable metal for electronic devices, and there is a need for an improved indium composition for electroplating indium metal, in particular, indium metal layers on metal substrates.

SUMMARY OF THE INVENTION

Compositions include one or more sources of indium ions, one or more 1,10-phenanthroline compounds in amounts of 0.1 ppm to 15 ppm and citric acid, salts thereof or mixtures thereof.

Methods include providing a substrate including a metal layer; contacting the substrate with an indium electroplating composition including one or more sources of indium ions, one or more 1,10-phenanthroline compounds in amounts of 0.1 ppm to 15 ppm and citric acid, salts thereof or mixtures thereof; and electroplating an indium metal layer on the metal layer with the indium electroplating composition.

The indium electroplating compositions can provide indium metal on a metal layer which is substantially void-free, uniform and has smooth morphology. The ability to reproducibly plate a void-free uniform indium of target thickness, and smooth surface morphology enables the expanded use of indium in the electronics industry, including in semiconductors and polycrystalline thin film solar cells. The indium deposited from the electroplating composition of the present invention can be used as a low temperature solder material which is desired for 3D stack assembly to reduce damage on assembled chips by the thermal stress induced during reflow processing. The indium can also be used as thermal interface materials to protect electronic devices such as microprocessors and integrated circuits. The present invention addresses a number of problems of the prior inability to electroplate indium of sufficient properties to meet requirements for applications in advanced electronic devices.

DETAILED DESCRIPTION OF THE INVENTIONS

Figure 1A:
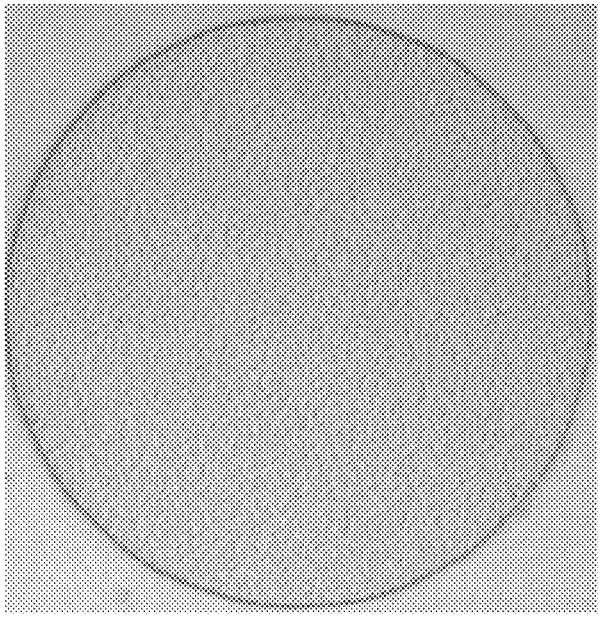
FIG. 1A is an optical microscope image of a nickel plated via having a diameter of 75 μm.

As used throughout the specification, the following abbreviations have the following meanings, unless the context clearly indicates otherwise: ° C.=degrees Centigrade; ° K=degrees Kelvin; g=gram; mg=milligram; L=liter; A=amperes; dm=decimeter; ASD=A/dm$^2$=current density; μm=micron=micrometer; ppm=parts per million; ppb=parts per billion; ppm=mg/L; indium ion=$In^{3+}$; $Li^+$=lithium ion; $Na^+$=sodium ion; $K^+$=potassium ion; $NH_4^+$=ammonium ion; nm=nanometers=$10^{-9}$ meters; μm=micrometers=$10^{-6}$ meters; M=molar; MEMS=micro-electro-mechanical systems; TIM=thermal interface material; IC=integrated circuits; EO=ethylene oxide and PO=propylene oxide.

The terms "depositing", "plating" and "electroplating" are used interchangeably throughout this specification. The term "copolymer" is a compound composed of two or more different mers. The term "dendrite" means branching spike-like metal crystals. Unless otherwise noted all plating baths are aqueous solvent based, i.e. water based, plating baths. All amounts are percent by weight and all ratios are by moles, unless otherwise noted. All numerical ranges are inclusive and combinable in any order except where it is logical that such numerical ranges are constrained to add up to 100%.

The compositions include one or more sources of indium ions which are soluble in an aqueous environment. The indium compositions are free of alloying metals. Such sources include, but are not limited to, indium salts of alkane sulfonic acids and aromatic sulfonic acids, such as methanesulfonic acid, ethanesulfonic acid, butane sulfonic acid, benzenesulfonic acid and toluenesulfonic acid, indium salts of sulfamic acid, sulfate salts of indium, chloride and bromide salts of indium, nitrate salts, hydroxide salts, indium oxides, fluoroborate salts, indium salts of carboxylic acids, such as citric acid, acetoacetic acid, glyoxylic acid, pyruvic acid, glycolic acid, malonic acid, hydroxamic acid, iminodiacetic acid, salicylic acid, glyceric acid, succinic acid, malic acid, tartaric acid, hydroxybutyric acid, indium salts of amino acids, such as arginine, aspartic acid, asparagine, glutamic acid, glycine, glutamine, leucine, lysine, threonine, isoleucine, and valine. Typically, the source of indium ions is one or more indium salts of sulfuric acid, sulfamic acid, alkane sulfonic acids, aromatic sulfonic acids and carboxylic acids. More typically, the source of indium ions is one or more indium salts of sulfuric acid and sulfamic acid.

The water-soluble salts of indium are included in the compositions in sufficient amounts to provide an indium deposit of the desired thickness. Preferably the water-soluble indium salts are included in the compositions to provide indium ($3^+$) ions in the compositions in amounts of 2 g/L to 70 g/L, more preferably from 2 g/L to 60 g/L, most preferably from 2 g/L to 30 g/L.

One or more 1,10-phenanthroline compounds are included in the indium compositions in trace amounts of 0.1 ppm to 15 ppm, preferably from 1 ppm to 10 ppm. 1,10-phenanthroline compounds include, but are not limited to those compounds having a formula:

(I)

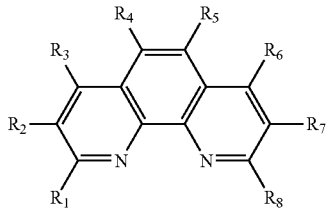

where $R_1$, $R_2$, $R_3$, $R_4$, $R_5$, $R_6$, $R_7$ and $R_8$ are independently chosen from hydrogen, linear or branched ($C_1$-$C_5$)alkyl, OH, linear or branched hydroxy($C_1$-$C_5$)alkyl, linear or branched ($C_1$-$C_5$)alkoxy, $NO_2$, substituted or unsubstituted phenyl, carboxyl, aldehyde, amino and primary, secondary or tertiary amino($C_1$-$C_5$)alkyl. Preferably $R_1$, $R_2$, $R_3$, $R_4$, $R_5$, $R_6$, $R_7$ and $R_8$ are independently chosen from hydrogen, ($C_1$-$C_2$)alkyl, —OH, hydroxyl($C_1$-$C_2$)alkyl, ($C_1$-$C_2$)alkoxy, —$NO_2$, substituted or unsubstituted phenyl, carboxyl, aldehyde amino and primary, secondary or tertiary amino($C_1$-$C_2$)alkyl. More preferably, $R_1$, $R_2$, $R_3$, $R_4$, $R_5$, $R_6$, $R_7$ and $R_8$ are independently chosen from hydrogen, OH, $NO_2$, amino, methyl, unsubstituted phenyl and carboxyl. Even more preferably, $R_1$, $R_2$, $R_3$, $R_4$, $R_5$, $R_6$, $R_7$ and $R_8$ are independently chosen from hydrogen, OH, amino and methyl.

Substituent groups on the phenyl include, but are not limited to OH, $NO_2$, hydroxy($C_1$-$C_5$)alkyl, amino, primary, secondary or tertiary amino($C_1$-$C_5$)alkyl or sulfonate or alkali metal salt thereof.

Examples of such 1,10-phenanthroline compounds are 1,10-phenanthroline, 5,6-dimethyl-1,10-phenanthroline, 2,9-dimethyl-1,10-phenanthroline, 2,4,7,9-tetramethyl-1,10-phenanthroline, 2,9-dimethyl-4,7-diphenyl-1,10-phenanthroline, 1,10-phenanthroline hydrate, 5-hydroxy-1,10-phenanthroline, 1,10-phenanthroline-5,6-diol, 4,7-diphenyl-1,10-phenanthroline, 2,9-diphenyl-1,10-phenanthroline, 1,10-phenanthroline-5-amine, 5,6-diamino-1,10-phenanthroline, 5-nitro-1,10-phenanthroline, 5-nitro-1,10-phenanthroline-2,9-dicarbaldehyde, 5-nitro-1,10-phenanthroline-2,9-dicarboxylic acid, 5-amino-1,10-phenanthroline-2,9-dicarboxylic acid, 1,10-phenanthroline-5,6-dicarboxylic acid, 1,10-phenanthroine-2,9-dicarboxylic acid and sodium 4,4'-(1,10-phenanthroline-4,7-diyl)di-benzene sulfonate. The most preferred is 1,10-phenanthroline.

Citric acid, salts thereof or mixtures thereof is included in the indium compositions. Citric acid salts include, but are not limited to sodium citrate dehydrate, monosodium citrate, potassium citrate and diammonium citrate. Citric acid, salts thereof or mixtures thereof can be included in amounts of 50 g/L to 300 g/L, preferably from 50 g/L to 200 g/L. Preferably a mixture of citric acid and its salts are included in the indium compositions in the foregoing amounts.

Optionally, but preferably, one or more sources of chloride ions are included in the indium electroplating compositions. Sources of chloride ions include, but are not limited to sodium chloride, potassium chloride, hydrogen chloride or mixtures thereof. Preferably the source of chloride ions is sodium chloride, potassium chloride or mixtures thereof. More preferably the source of chloride ions is sodium chloride. One or more sources of chloride ions are included in the indium compositions such that a molar ratio of chloride ions to indium ions is at least 2:1, preferably from 2:1 to 7:1, more preferably from 4:1 to 6:1.

Optionally, in addition to citric acid, its salts or mixtures thereof, one or more additional buffers can be included in the indium compositions to provide a pH of 1-4, preferably from 2-3. The buffer includes an acid and the salt of its conjugate base. Acids include amino acids, carboxylic acids, glyoxylic acid, pyruivic acid, hydroxamic acid, iminodiacetic acid, salicylic acid, succinic acid, hydroxybutyric acid, acetic acid, acetoacetic acid, tartaric acid, phosphoric acid, oxalic acid, carbonic acid, ascorbic acid, boric acid, butanoic acid, thioacetic acid, glycolic acid, malic acid, formic acid, heptanoic acid, hexanoic acid, hydrofluoric acid, lactic acid, nitrous acid, octanoic acid, pentanoic acid, uric acid, nonanoic acid, decanoic acid, sulfurous acid, sulfuric acid, alkane sulfonic acids and aryl sulfonic acids such as methanesulfonic acid, ethanesulfonic acid, benzenesulfonic acid, toluenesulfonic acid, sulfamic acid. The acids are combined with $Li^+$, $Na^+$, $K^+$, $NH_4^+$ or $(C_nH_{(2n+1)})_4N^+$ salts of conjugate bases where n is an integer from 1 to 6.

Optionally, one or more surfactants can be included in the indium compositions. Such surfactants include, but are not limited to amine surfactants such as quaternary amines, commercially available as TOMAMINE®-Q-C-15 surfactant, amine oxides, commercially available as TOMAMINE®-AO-455 surfactant, both available from Air Products; hydrophilic polyether monoamine commercially available as SURFONAMINE® L-207 amine surfactant from Huntsman; polyethyleneglycol octyl (3-sulfopropyl) diether commercially available as RALUFON® EA 15-90 surfactant; [(3-sulfopropoxy)-polyalkoxy]-β-naphthyl ether, potassium salt, commercially available as RALUFON® NAPE 14-90 surfactant, octaethyleneglycol octyl ether, commercially available as RALUFON® EN 16-80 surfactant, polyethyleneglycol alkyl (3-sulfopropyl) diether, potassium salt, commercially available as RALUFON® F 11-3 surfactant, all are obtainable from Raschig GmbH; EO/PO block copolymers, commercially available as TETRONIC®-304 surfactant, available from BSF; ethoxylated β-naphthol from Schaerer & Schlaepfer AG such as ADUXOL™ NAP-08, ADUXOL™ NAP-03, ADUXOL™ NAP-06; ethoxylated 2,4,7,9-Tetramethyl-5-decyne-4,7-diol such as SURFYNOL® 484 surfactant from Air Products and Chemicals Co.; LUX™ BN-13 surfactant, ethoxylated β-naphthol, such as TIB Chemicals LUX™ NPS surfactant; ethoxylated-β-naphthols such as POLYMAX® PA-31 surfactant available from PCC Chemax, Inc. Such surfactants are included in amounts of 1 ppm to 10 g/L, preferably from 5 ppm to 5 g/L.

Optionally, the indium compositions can include one or more grain refiners. Such grain refiners include, but are not limited to 2-picolinic acid, Sodium 2-napthol-7-sulfonate, 3-(benzothiazol-2-ylthio)propane-1-sulfonic acid (ZPS), 3-(carbamimidoylthio)propane-1-sulfonic acid (UPS), bis (sulfopropyl)disulfide (SPS), mercaptopropane sulfonic acid (MPS), 3-N,N-dimethylaminodithiocarbamoyl-1-propane sulfonic acid (DPS), and (O-ethyldithiocarbonato)-S-(3-sulfopropyl)-ester (OPX). Preferably such grain refiners are included in the indium compositions in amounts of 0.1 ppm to 5 g/L, more preferably from 0.5 ppm to 1 g/L.

Optionally, one or more suppressors can be included in the indium compositions. Suppressors include, but are not limited to triethanolamine and its derivatives, such as triethanolamine lauryl sulfate, sodium lauryl sulfate and ethoxylated ammonium lauryl sulfate, polyethyleneimine and its derivatives, such as hydroxypropylpolyeneimine (HPPEI-200), and alkoxylated polymers. Such suppressors are included in the indium compositions in conventional amounts. Typically, suppressors are included in amounts of 1 ppm to 5 g/L.

Optionally, one or more levelers can be included in the indium compositions. Levelers include, but are not limited to, polyalkylene glycol ethers. Such ethers include, but are not limited to, dimethyl polyethylene glycol ether, di-tertiary butyl polyethylene glycol ether, polyethylene/polypropylene dimethyl ether (mixed or block copolymers), and octyl monomethyl polyalkylene ether (mixed or block copolymer). Such levelers are included in conventional amounts. In general, such levelers are included in amounts of 100 ppb to 500 ppb.

Optionally, one or more hydrogen suppressors can included in the indium compositions to suppress hydrogen gas formation during indium metal electroplating. Hydrogen suppressors include epihalohydrin copolymers. Epihalohydrins include epichlorohydrin and epibromohydrin. Typically, copolymers of epichlorohydrin are used. Such copolymers are water-soluble polymerization products of epichlorohydrin or epibromohydrin and one or more organic compounds which includes nitrogen, sulfur, oxygen atoms or combinations thereof.

Nitrogen-containing organic compounds copolymerizable with epihalohydrins include, but are not limited to:

1) aliphatic chain amines;
2) unsubstituted heterocyclic nitrogen compounds having at least two reactive nitrogen sites; and,
3) substituted heterocyclic nitrogen compounds having at least two reactive nitrogen sites and having 1-2 substitution groups chosen from alkyl groups, aryl groups, nitro groups, halogens and amino groups.

Aliphatic chain amines include, but are not limited to, dimethylamine, ethylamine, methylamine, diethylamine, triethyl amine, ethylene diamine, diethylenetriamine, propylamine, butylamine, pentylamine, hexylamine, heptylamine, octylamine, 2-ethylhexylamine, isooctylamine, nonylamine, isononylamine, decylamine, undecylamine, dodecylaminetridecylamine and alkanol amines.

Unsubstituted heterocyclic nitrogen compounds having at least two reactive nitrogen sites include, but are not limited to, imidazole, imidazoline, pyrazole, 1,2,3-triazole, tetrazole, pyradazine, 1,2,4-triazole, 1,2,3-oxadiazole, 1,2,4-thiadiazole and 1,3,4-thiadiazole.

Substituted heterocyclic nitrogen compounds having at least two reactive nitrogen sites and having 1-2 substitutions groups include, but are not limited to, benzimidazole, 1-methylimidazole, 2-methylimidazole, 1,3-diemthylimidazole, 4-hydroxy-2-amino imidazole, 5-ethyl-4-hydroxyimidazole, 2-phenylimidazoline and 2-tolylimidazoline.

Preferably, one or more compounds chosen from imidazole, pyrazole, imidazoline, 1,2,3-triazole, tetrazole, pyridazine, 1,2,4-triazole, 1,2,3-oxadiazole, 1,2,4-thiadiazole and 1,3,4-thiadiazole and derivatives thereof which incorporate 1 or 2 substituents chosen from methyl, ethyl, phenyl and amino groups are used to form the epihalohydrin copolymer.

Some of the epihalohydrin copolymers are commercially available such as from Raschig GmbH, Ludwigshafen Germany and from BASF, Wyandotte, Mich., USA, or may be made by methods disclosed in the literature. An example of a commercially available imidazole/epichlorohydrin copolymer is LUGALVAN® IZE copolymer, obtainable from BASF.

Epihalohydrin copolymers can be formed by reacting epihalohydrins with the nitrogen, sulfur or oxygen containing compounds described above under any suitable reaction conditions. For example, in one method, both materials are dissolved in suitable concentrations in a body of mutual solvent and reacted therein at, for example, 45 to 240 minutes. The aqueous solution chemical product of the reaction is isolated by distilling off the solvent and then is added to the body of water which serves as the electroplating solution, once the indium salt is dissolved. In another method these two materials are placed in water and heated to 60° C. with constant vigorous stirring until they dissolve in the water as they react.

A wide range of ratios of the reaction compound to epihalohydrin can be used, such as from 0.5:1 to 2:1 moles. Typically the molar ratio is from 0.6:1 to 2:1 moles, more typically the molar ratio is 0.7 to 1:1, most typically the molar ratio is 1:1.

Additionally, the reaction product may be further reacted with one or more reagents before the electroplating composition is completed by the addition of indium salt. Thus, the described product may be further reacted with a reagent which is at least one of ammonia, aliphatic amine, polyamine and polyimine. Typically, the reagent is at least one of ammonia, ethylenediamine, tetraethylene pentamine and a polyethyleneimine having a molecular weight of at least 150, although other species meeting the definitions set forth herein may be used. The reaction can take place in water with stirring.

For example, the reaction between the reaction product of epichlorohydrin and a nitrogen-containing organic compound as described above and a reagent chosen from one or more of ammonia, aliphatic amine, and arylamine or polyimine can take place and can be carried out at a temperature of, for example, 30° C. to 60° C. for, example, 45 to 240 minutes. The molar ratio between the reaction product of the nitrogen containing compound-epichlorohydrin reaction and the reagent is typically 1:0.3-1.

The epihalohydrin copolymers are included in the compositions in amounts of 0.01 g/L to 100 g/L. preferably, epihalohydrin copolymers are included in amounts of 0.1 g/L to 80 g/L, more preferably, they are included in amounts of 0.1 g/L to 50 g/L, most preferably in amounts of 1 g/L to 30 g/L.

The indium compositions may be used to deposit substantially uniform, void-free, indium metal layers on metal layers of various substrates. The indium layers are also substantially dendrite-free. The indium layers preferably range in thickness from 10 nm to 100 μm, more preferably from 100 nm to 75 μm.

Apparatus used to deposit indium metal on metal layers is conventional. Preferably conventional soluble indium electrodes are used as the anode. Any suitable reference electrode may be used. Typically, the reference electrode is a silver chloride/silver electrode. Current densities may range from 0.1 ASD to 10 ASD, preferably from 0.1 to 5 ASD, more preferably from 1 to 4 ASD.

The temperatures of the indium compositions during indium metal electroplating can range from room temperature to 80° C. Preferably, the temperatures range from room temperature to 65° C., more preferably from room temperature to 60° C. Most preferably the temperature is room temperature.

The indium compositions may be used to electroplate indium metal on nickel, copper, gold and tin layers of various substrates, including components for electronic devices, for magnetic field devices and superconductivity MRIs. Preferably indium is electroplated on nickel. The metal layers preferably range from 10 nm to 100 μm, more preferably from 100 nm to 75 μm. The indium compositions may also be used with conventional photoimaging methods to electroplate indium metal small diameter solder bumps on various substrates such as silicon wafers. Small diameter bumps preferably have diameters of 1 μm to 100 μm, more preferably from 2 μm to 50 μm, with aspect ratios of 1 to 3.

For example, the indium compositions may be used to electroplate indium metal on a component for an electrical device to function as a TIM, such as for, but not limited to, ICs, microprocessors of semiconductor devices, MEMS and components for optoelectronic devices. Such electronic components may be included in printed wiring boards and hermetically sealed chip-scale and wafer-level packages. Such packages typically include an enclosed volume which is hermetically sealed, formed between a base substrate and lid, with the electronic device being disposed in the enclosed volume. The packages provide for containment and protection of the enclosed device from contamination and water vapor in the atmosphere outside the package. The presence of contamination and water vapor in the package can give rise to problems such as corrosion of metal parts as well as optical losses in the case of optoelectronic devices and other optical components. The low melting temperature (156° C.) and high thermal conductivity (~82 W/m° K) are properties which make indium metal highly desirable for use as a TIM.

In addition to TIMs, the indium compositions may be used to electroplate underlayers on substrates to prevent whisker formation in electronic devices. The substrates include, but are not limited to, electrical or electronic components or parts such as film carriers for mounting semiconductor chips, printed circuit boards, lead frames, contacting elements such as contacts or terminals and plated structural members which demand good appearance and high operation reliability.

The following examples further illustrate the invention, but are not intended to limit the scope of the invention.

Example 1 (Comparative)

Photoresist patterned silicon wafers from Silicon Valley Microelectronics, Inc. with a plurality of vias having a diameter of 75 μm and copper seed layer at the base of each via were electroplated with a nickel layer using NIKAL™ BP nickel electroplating bath available from Dow Advanced Materials. Nickel electroplating was done at 55° C., with a cathode current density of 1 ASD for 120 seconds. A conventional rectifier supplied the current. The anode was a soluble nickel electrode. After plating the silicon wafer was removed from the plating bath, the photoresist was stripped from the wafers with SHIPLEY BPR™ Photostripper available from Dow Advanced Materials and rinsed with water. The nickel deposits appeared substantially smooth and without any observable dendrites on the surface. FIG. 1A is an optical image of one of the nickel plated copper seed layers taken with a LEICA™ optical microscope.

The following aqueous indium electrolytic composition was prepared:

TABLE 1

| COMPONENT | AMOUNT |
|---|---|
| Indium sulfate | 45 g/L |
| Citric acid | 96 g/L |
| Sodium citrate dihydrate | 59 g/L |

The foregoing nickel layer electroplating process was repeated on another set of photoresist patterned wafers except that after electroplating the nickel layer, the nickel plated silicon wafers were immersed in the indium electroplating composition and indium metal was electroplated on the nickel. Indium electroplating was done at 25° C. at a current density of 4ASD for 30 seconds. The pH of the indium electroplating composition was 2.4. The anode was an indium soluble electrode. After the indium was plated on the nickel, the photoresist was stripped from the wafers and the morphology of the indium deposits was observed. All of the indium deposits appeared rough.

Figure 1B:
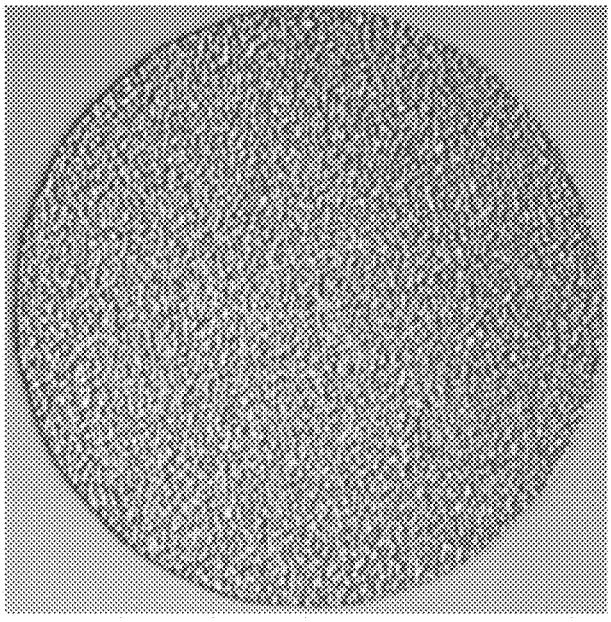
FIG. 1B is an optical microscope image of an indium layer on a nickel plated via having a diameter of 75 μm.

FIG. 1B is an optical image of one of the indium metal deposits electroplated on the nickel layer. The indium deposit was very rough in contrast to the nickel deposit as shown in FIG. 1A.

Example 2

The method described in Example 1 above was repeated except that the indium electroplating composition included the following components:

TABLE 2

| COMPONENT | AMOUNT |
|---|---|
| Indium sulfate | 45 g/L |
| Citric acid | 128 g/L |
| Sodium citrate dihydrate | 59 g/L |
| 1,10-phenanthroline | 8 ppm |

The nickel plated silicon wafers were immersed in the indium electroplating composition and indium metal was electroplated on the nickel. Indium electroplating was done at 25° C. at a current density of 4ASD for 30 seconds. The pH of the composition was 2.1. The anode was an indium soluble electrode. After indium was electroplated on the nickel layers, the photoresist was stripped from the wafers and the indium morphology was observed. All of the indium deposits appeared uniform and smooth.

Figure 2:
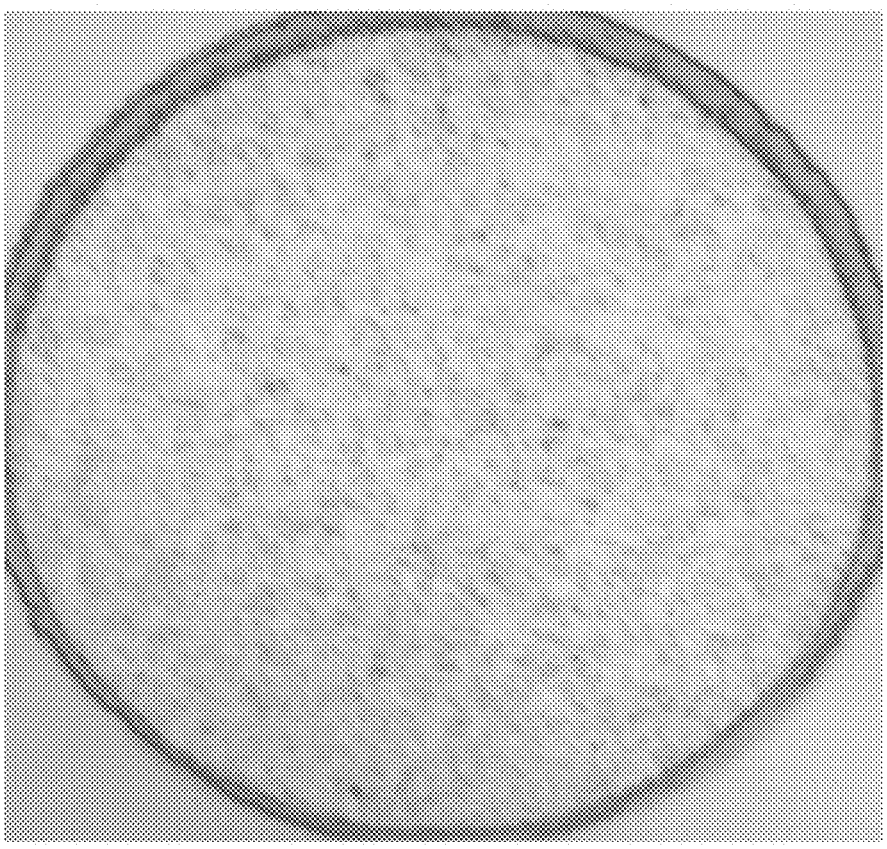
FIG. 2 is a an optical microscope image of an indium layer on a nickel plated via having a diameter of 75 μm where the indium was electroplated from an indium composition containing 8 ppm of 1,10-phenanthroline.

FIG. 2 is an optical microscope image of one of the indium metal deposits electroplated on the nickel layer. The indium deposit appeared smooth in contrast to the indium deposit of FIG. 1B.

Example 3

The method described in Example 2 above was repeated, except the indium electroplating composition included the following components:

TABLE 3

| COMPONENT | AMOUNT |
|---|---|
| Indium sulfate | 45 g/L |
| Citric acid | 96 g/L |
| Sodium citrate dihydrate | 59 g/L |
| 1,10-phenanthroline | 4 ppm |
| Sodium chloride[1] | 50 g/L |

[1]Molar ratio of chloride:indium ions = 5:1

The pH of the indium composition was 2.4. The nickel plated silicon wafers were immersed in the indium electroplating composition and indium metal was electroplated on the nickel. Indium electroplating was done at 25° C. at a current density of 4ASD for 30 seconds. The anode was an indium soluble electrode. After indium was electroplated on the nickel layers, the photoresist was stripped from the wafers and the indium morphology was observed. All of the indium deposits appeared uniform and smooth.

Figure 3:
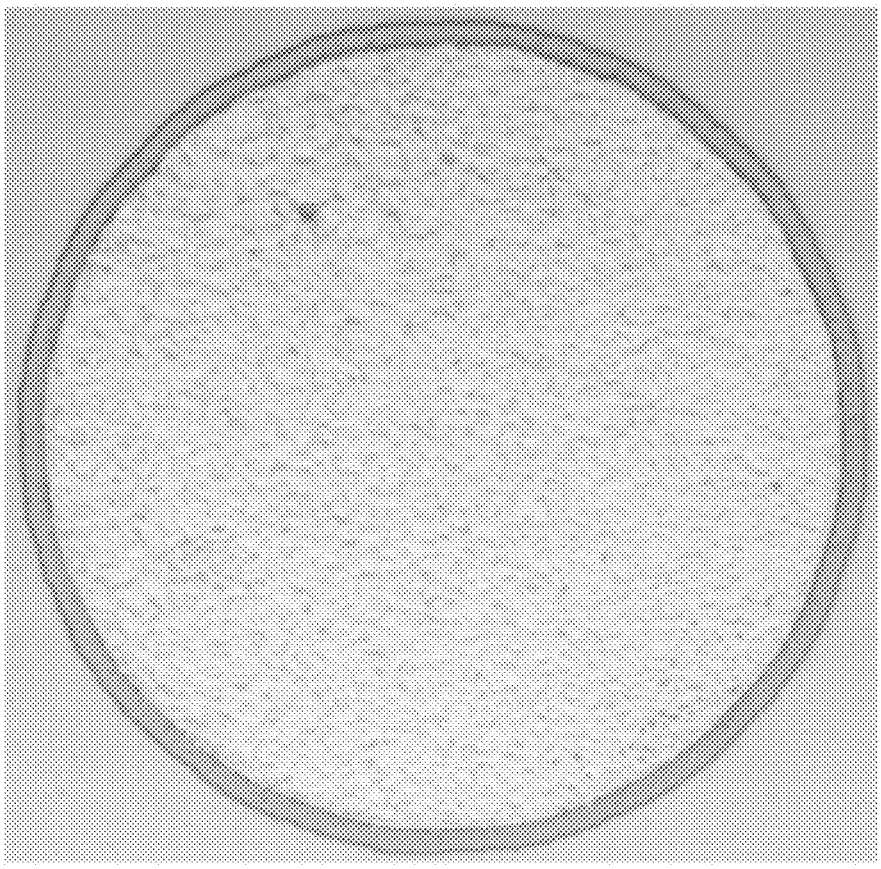
FIG. 3 is an optical microscope image of an indium layer on a nickel plated via having a diameter of 75 μm where the indium was electroplated from an indium composition containing 4 ppm of 1,10-phenanthroline and 50 g/L sodium chloride.

FIG. 3 is an optical microscope image of one of the indium metal deposits electroplated on the nickel layer. The indium deposit appeared smooth in contrast to the indium deposit of FIG. 1B.

Example 4

The method described in Example 2 above is repeated, except the indium electroplating composition includes the following components:

TABLE 4

| COMPONENT | AMOUNT |
|---|---|
| Indium sulfate | 45 g/L |
| Citric acid | 128 g/L |
| Sodium citrate dihydrate | 59 g/L |
| 5,6-dimethyl-1,10-phenanthroline | 1 ppm |

The pH of the composition is 2.1. After indium is electroplated on the nickel layers, the photoresist is stripped from the wafers and the indium morphology is observed. All of the indium deposits are expected to appear uniform and smooth as shown in FIG. 2.

Example 5

The method described in Example 2 above is repeated except that the indium electroplating composition includes the following components:

TABLE 5

| COMPONENT | AMOUNT |
|---|---|
| Indium sulfate | 45 g/L |
| Citric acid | 128 g/L |
| Sodium citrate dihydrate | 59 g/L |
| 2,9-dimethyl-1,10-phenanthroline | 5 ppm |

The pH of the composition is 2.1. After indium is electroplated on the nickel layers, the photoresist is stripped from the wafers and the indium morphology is observed. All of the indium deposits are expected to appear uniform and smooth as shown in FIG. 2.

Example 6

An indium electroplating composition which includes the following components is prepared:

TABLE 6

| COMPONENT | AMOUNT |
|---|---|
| Indium sulfate | 45 g/L |
| Citric acid | 128 g/L |
| Sodium citrate dihydrate | 59 g/L |
| 2,9-dimethyl-4,7-diphenyl-1,10-phenanthroline | 0.25 ppm |
| Quaternary amine surfactant[2] | 5 ppm |

[2]TOMAMINE ® QC-15 surfactant available from Air Products

The pH of the composition is 2.1. After indium is electroplated on the nickel layers, the photoresist is stripped from the wafers and the indium morphology is observed. All of the indium deposits are expected to appear uniform and smooth as shown in FIG. 2.

Example 7

An indium electroplating composition which includes the following components is prepared:

TABLE 7

| COMPONENT | AMOUNT |
|---|---|
| Indium sulfate | 45 g/L |
| Citric acid | 128 g/L |
| Sodium citrate dihydrate | 59 g/L |
| 5-hydroxy-1,10-phenanthroline | 10 ppm |
| Polyethyleneglycol octyl (3-sulfopropyl) diether[3] | 10 ppm |

[3]RALUFON ® EA 15-90 surfactant available from Raschig

The pH of the composition is 2.1. After indium is electroplated on the nickel layers, the photoresist is stripped from the wafers and the indium morphology is observed. All of the indium deposits are expected to appear uniform and smooth as shown in FIG. 2.

Example 8

An indium electroplating composition which includes the following components is prepared:

TABLE 8

| COMPONENT | AMOUNT |
|---|---|
| Indium sulfate | 45 g/L |
| Citric acid | 128 g/L |
| Sodium citrate dihydrate | 59 g/L |
| 5,6-diamino-1,10-phenanthroline | 5 ppm |
| Quaternary amine surfactant[4] | 5 ppm |
| Sodium 2-naphthol-7-sulfonate | 0.1 g/L |

[4]TOMAMINE ® QC-15 surfactant available from Air Products

After indium is electroplated on the nickel layers, the photoresist is stripped from the wafers and the indium morphology is observed. All of the indium deposits are expected to appear uniform and smooth as shown in FIG. 2.

Example 9 (Comparative)

The method described in Example 2 above was repeated except that the indium electroplating composition included the following components:

TABLE 9

| COMPONENT | AMOUNT |
|---|---|
| Indium sulfate | 45 g/L |
| Citric acid | 96 g/L |
| Sodium citrate dihydrate | 59 g/L |
| 1,10-phenanthroline | 20 ppm |
| Sodium chloride | 50 g/L |

Figure 4:
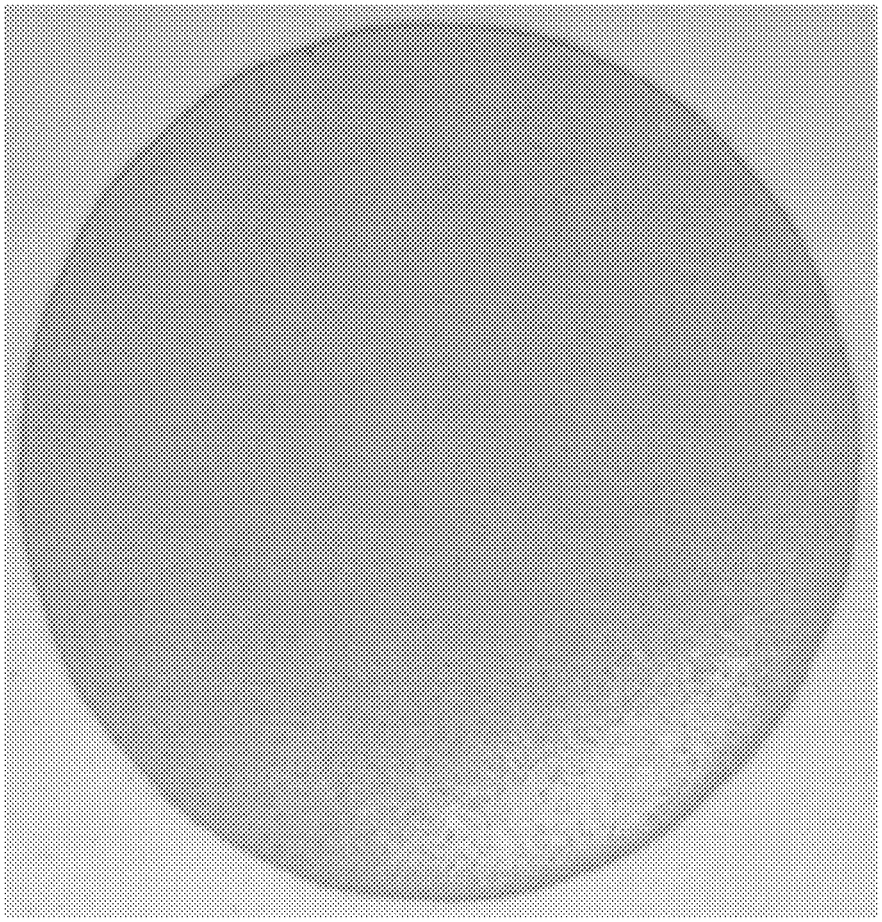
FIG. 4 is an optical microscope image of a nickel plated via having a diameter of 75 μm without any indium deposit after attempting to electroplate the nickel with an indium composition containing 20 ppm of 1,10-phenanthroline.

The pH of the compositions was 2.4. After indium was electroplated on the nickel layers, the photoresist was stripped from the wafers and the indium morphology was observed. There were no observable indium deposits on any of the nickel layers. FIG. 4 is an optical microscope image of one of the nickel layers taken after indium plating. There was no indication that indium plated on the nickel.

What is claimed is:

1. A method comprising:

a) providing a substrate comprising a metal layer;

b) contacting the substrate with an indium electroplating composition comprising one or more sources of indium ions, one or more 1,10-phenanthroline compounds in amounts of 0.1 ppm to 15 ppm and citric acid, salt of citric acid or mixtures thereof; and c) electroplating an indium metal layer on the metal layer of the substrate with the indium electroplating composition.

2. The method of claim 1, wherein the indium electroplating composition further comprises one or more sources of chloride ions, wherein a molar ratio of the chloride ions to the indium ions is 2:1 or greater.

3. The method of claim 1, wherein the metal layer is nickel, copper, gold or tin.

4. The method of claim 3, wherein the metal layer is nickel.

5. The method of claim 1, wherein the metal layer is 10 nm to 100 μm thick.

6. The method of claim 1, wherein the indium metal layer is 10 nm to 100 μm thick.

* * * * *